US006688149B2

(12) United States Patent
Friese

(10) Patent No.: US 6,688,149 B2
(45) Date of Patent: Feb. 10, 2004

(54) COMPONENT WITH A HUB, AND A NON-CUTTING PRODUCTION METHOD THEREFOR

(75) Inventor: Udo Friese, Ahlen (DE)

(73) Assignee: WF-Maschinenbau und Blechformtechnik GmbH & Co. KG, Sendenhorst (DE)

( * ) Notice: Subject to any disclaimer, the term of this patent is extended or adjusted under 35 U.S.C. 154(b) by 0 days.

(21) Appl. No.: 10/203,745

(22) PCT Filed: Jan. 23, 2001

(86) PCT No.: PCT/EP01/00698

§ 371 (c)(1),
(2), (4) Date: Aug. 13, 2002

(87) PCT Pub. No.: WO01/60543

PCT Pub. Date: Aug. 23, 2001

(65) Prior Publication Data

US 2003/0009884 A1 Jan. 16, 2003

(30) Foreign Application Priority Data

Feb. 15, 2000 (DE) ..... 100 06 803

(51) Int. Cl.[7] ..... B21D 22/14
(52) U.S. Cl. ..... 72/71; 72/82; 29/894.362
(58) Field of Search ..... 72/71, 82, 83, 72/84; 29/894.362; 474/94; 11/178

(56) References Cited

U.S. PATENT DOCUMENTS 5,619,879 A * 4/1997 Friese ..... 72/82
5,951,422 A * 9/1999 Roes et al. ..... 474/94
5,987,952 A * 11/1999 Kutzscher et al. ..... 72/71

FOREIGN PATENT DOCUMENTS

DE 199 16 280 A1 8/2000
WO WO 94/20235 9/1994

* cited by examiner

*Primary Examiner*—Ed Tolan
(74) *Attorney, Agent, or Firm*—Barnes & Thornburg

(57) ABSTRACT

A method for the non-cutting production of a hub with a stepped hole, the method steps comprising: providing a metal round blank having a throughhole; providing a patch block in the throughhole and having a portion of the patch block spaced at a distance from the metal round blank so as to create a stepped area displaced from a plane of the top surface of the metal round blank; and, cold-forming the hub by use of at least one pressure roller with the at least one pressure roller fed radially towards the throughhole, wherein material from the metal round blank flows into the stepped area between the metal round blank and a portion of the patch block, thereby forming a stepped hole comprising a material web at an inner circumference of the hub. A hub with a stepped hole, produced from a metal round blank by a compression method.

7 Claims, 3 Drawing Sheets

Figure 3A:
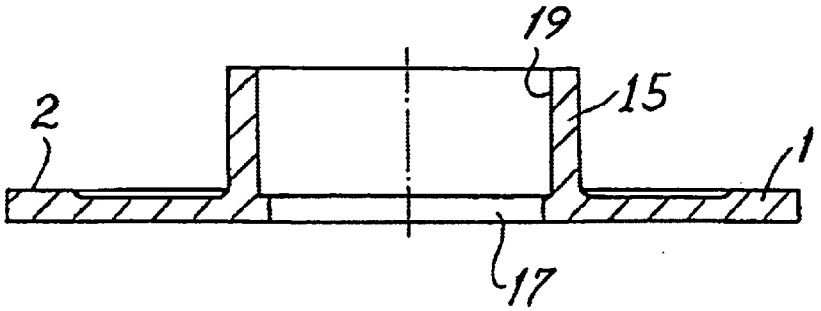
Fig. 3a PRIOR ART

Fig. 1b
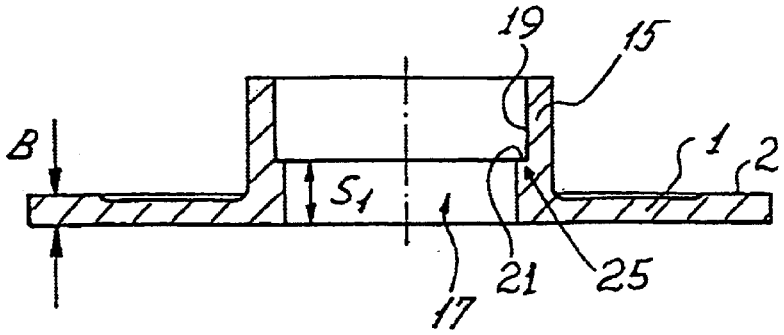
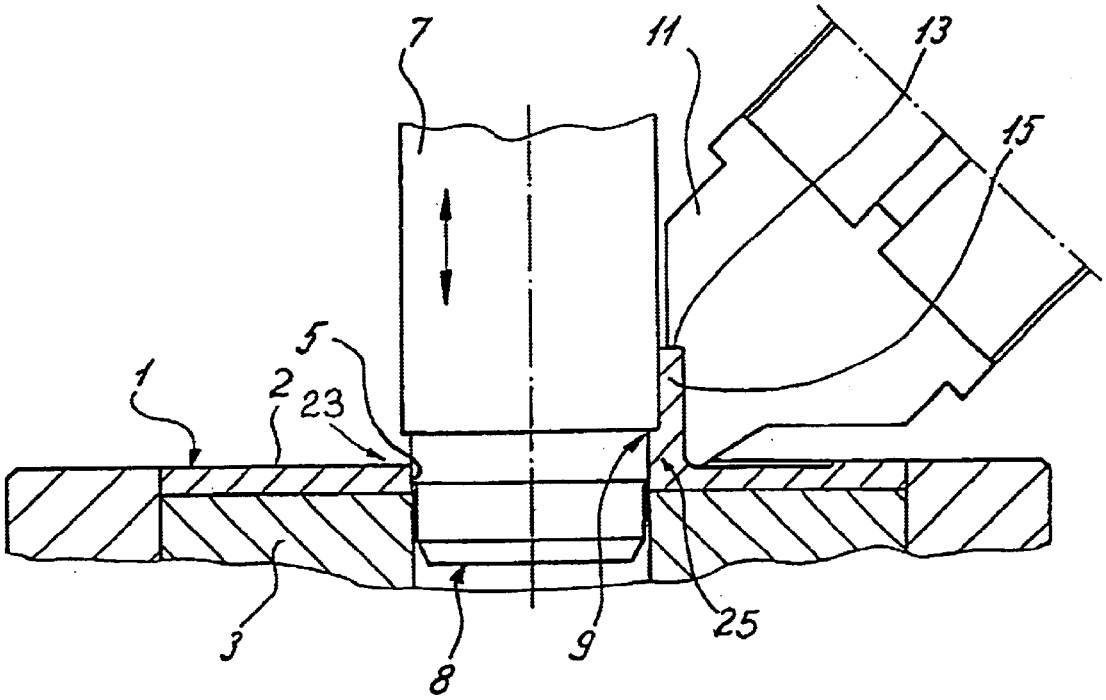
Fig. 1a

Fig. 2b
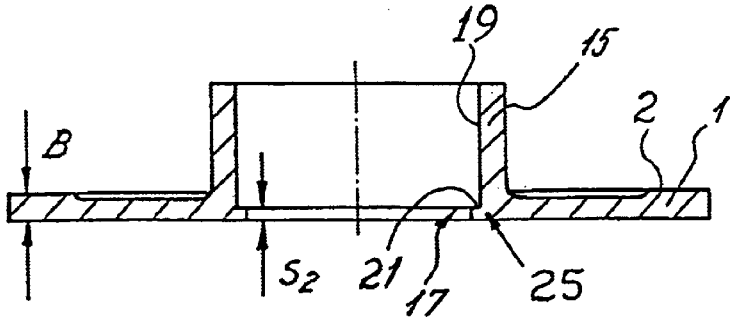
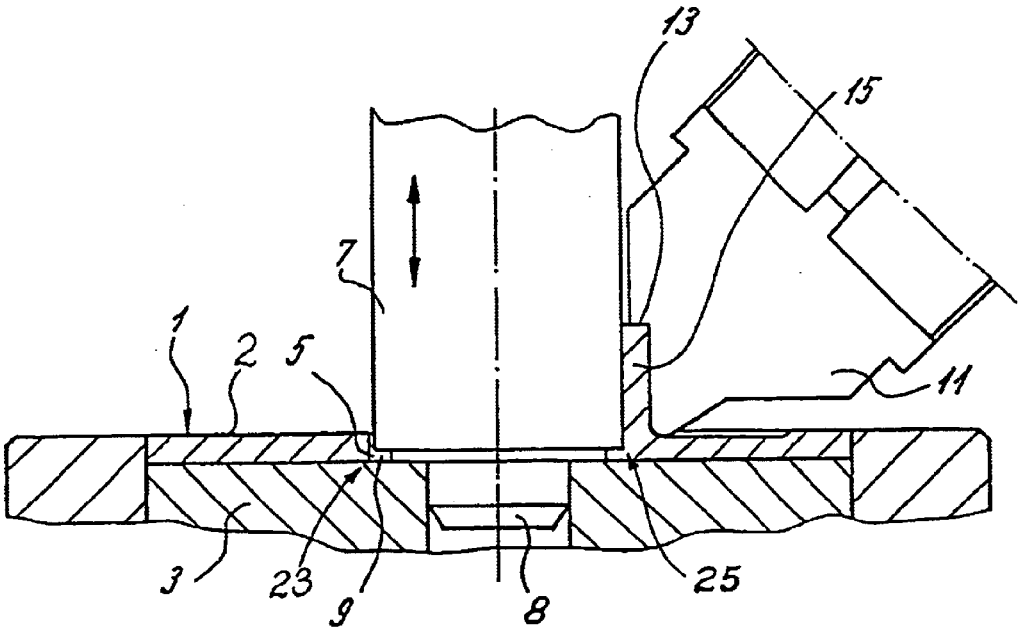
Fig. 2a

COMPONENT WITH A HUB, AND A NON-CUTTING PRODUCTION METHOD THEREFOR

The invention concerns a method for non-cutting manufacture of a component, in particular a gear part, with a hub, whereas the hub shows a stepped hole, thanks to cold-forming according to a compression method which, using a rotary metal round blank with a through hole, forms the hub extending substantially radially to the plane of the metal round blank by means of at least one rotary pressure roller so that the pressure roller is fed radially from the outside to the inside, engaging into the metal round blank, at least intermittently and temporarily, as well as a hub manufactured according to such a method.

This method of manufacture of a hub using a compression process is known since the patent WO 94/20235. This method is developed further in the patent DE 44 44 526 CI, according to the teaching thereof the external circumferential edge of the sheet plate is supported during the compression process in order to provide an end lining resting against the circumferential edge of the metal round blank.

Moreover, it is known since the patent U.S. Pat. No. 5,951,44 as well as parallel documents of the family of patents belonging to this document, how to form a stepped hole, a so-called 'blind hole' intended for pulley hubs so that a stepped patch block shows a through hole such that an edge/a ring surface of the patch block resting at the outside circumference of the metal round blank held in the end lining, on the metal round blank and the portion of the patch block providing the through hole of the metal round blank exhibits an internal diameter matching the metal round blank. Thus, the provision of the hub leaves an internal web at the hub, forming the stepped hole which is required by the design in several applications or which can be machine faced in order to confer a particular shape to the edges of the internal contour. The geometry of the stepped hole of the hub after compression always matches the thickness of the metal round blank in this area before ausforming.

In the light of the technology available, the object of the invention is to provide a method to manufacture hubs with stepped hole geometries which differ from the initial thickness of the metal round blank in this domain, thereby breaking away from the technology available.

The object of the invention is met by the characteristic of the claim 1. A material web, extending substantially inwardly away from the hub, is formed at the inner circumference of the hub so that during ausforming of the hub at least a portion of a patch block is provided at a distance from the metal round blank whereas during the development of the hub, material of the metal round blank flows in the gap between the metal round blank and the patch block, thereby forming the stepped hole.

The invention differs from the patent U.S. Pat. No. 5,951,422 inasmuch as the patch block rests directly on the round blank before ausforming in order to prevent the material from flowing in the area of the stepped hole to be developed. It contradicts the teaching of this document whereby it does not position the patch block at the round blank but arranges said patch block to enable the material to flow even in the area of inner diameter of the hub, whereas it is possible to confer a variable geometry to the hub in the area of the stepped hole, a variable geometry which matches the shape of the patch block in the area of the stepped hole.

Thus, according to a preferred embodiment of the invention, the patch block and/or the pin shows a widening diameter in the area of the through hole, outside the through hole, so that the area of the web is increased when forming the hub, with respect to the initial thickness of the metal round blank, which was not possible with the patent U.S. Pat. No. 5,951,422.

According to another embodiment of the invention, the patch block and/or the pin is provided in the area of the through hole with one or several diameter(s) which is/are smaller than the diameter of the through hole so that when developing the hub, material flows inwardly from the inner diameter of the metal round blank and so that the diameter and/or the height of the web of the hub is reduced with respect to the initial thickness of the metal round blank. It is also surprisingly possible to make the web thinner with respect to its thickness and smaller with respect to its diameter than the initial material of the metal round blank if the metal round blank is fitted with a matching large through hole wherein the patch block penetrates with a stepped area. This was also not possible according to the teaching of the patent U.S. Pat. No. 5,951,422.

With respect to the technology provided by the patent U.S. Pat. No. 5,951,422, the number of embodiments can be increased significantly when building a hub out of a form of a metal round blank without making the manufacture of a hub properly speaking more complicated, since the metal 'flows' during the manufacture of the hub quasi 'automatically' in the area between the metal round blank and the patch block arranged at a distance from said metal.

The inner circumferential web can take on any shape in the area of the stepped hole using the invention. If the patch block is conical in shape (at least in the area of the portion penetrating the through hole) the web takes on a conical shape in this area. Similarly, other contours can be developed in the area of the inner circumference, for example various curves or gradations of different types.

The remaining characteristics of the claims will describe other advantageous embodiments of the invention.

Figure 3B:
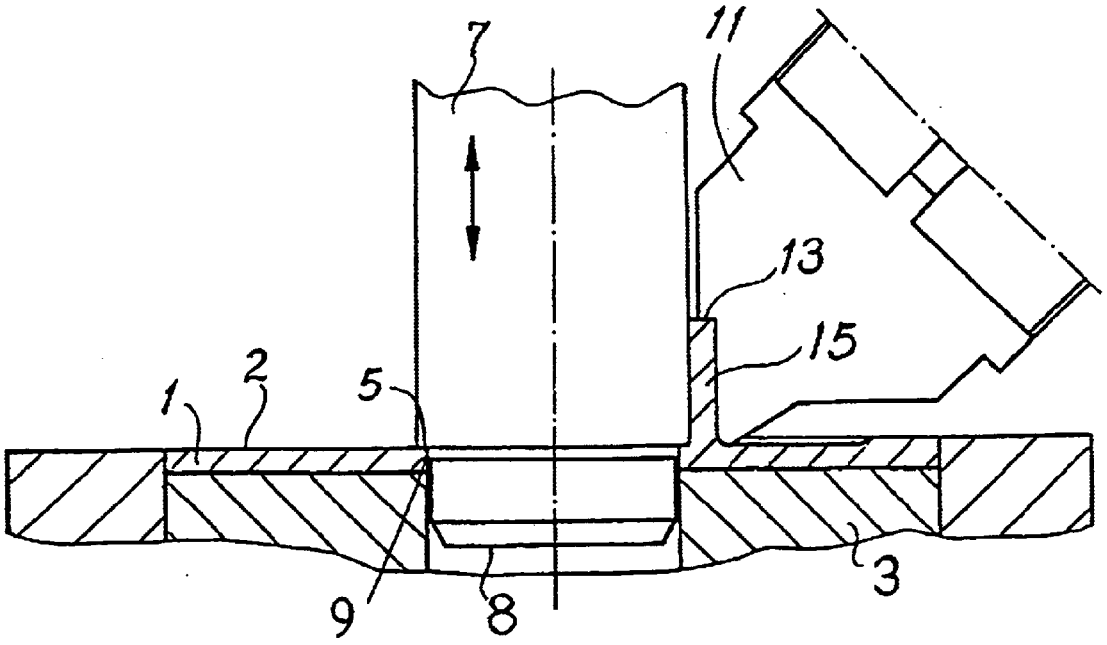
Fig. 3b PRIOR ART

The invention will be described more in detail with reference to the appended drawings and to several embodiments, wherein:

FIGS. 1*a,b* illustrates a first embodiment of a method according to the invention for the manufacture of a hub;

FIGS. 2*a,b* illustrates a second embodiment of a method according to the invention for the manufacture of a hub; and FIG. 3 illustrates an embodiment of a method of manufacture of a hub according to the technology available.

FIGS. 1 to 3 illustrate a metal round blank (sheet plate) 1 which is held by a tool 3 at its external circumferential whereas the through hole 5 of the metal round blank is penetrated by a stepped patch block 7 with a conical centring pin 8. As the gradation 9 is formed at a distance from the sheet metal round blank, it is not only the hub 15 that is compressed during the motion of a rotary pressure roller 11 with a shoulder 13 to limit the radial extension from outside towards the inside, starting from the metal round blank, but material is also compressed between the patch block 7 and the metal round blank 3 in order to provide the stepped hole 17 whereof the height of the web S is now greater than the initial thickness B of the metal round blank. The stepped hole 17 is also formed using material of the metal round blank 1 whereas said material flows or is compressed from the metal round blank 1 into the area of the stepped hole properly speaking.

Conversely, FIG. 2 illustrates a web height S2 which is smaller than the thickness B of the metal round blank 1 whereas moreover the diameter of the stepped hole 17 is smaller than the diameter of the through hole of the metal round blank 1. For this embodiment, the round blank 1 is fixed in the tool 3 at the external diameter and is fed with its gradation 9 into the through hole. The gradation 9 enables to develop a stop edge or a stepped hole 17 with reduced diameter with respect to the initial diameter of the round metal and with reduced height of the web in the stepped hole 17.

Reference Signs

| | |
|---|---|
| Metal round blank | 1 |
| Tool | 3 |
| Through hole | 5 |
| Patch block | 7 |
| Centring pin | 8 |
| Gradation | 9 |
| Pressure roller | 11 |
| Shoulder | 13 |
| Hub | 15 |
| Stepped hole | 17 |
| Web width | S1, S2 |
| Metal round blank width | B |

What is claimed is:

1. A method for the non-cutting production of a hub with a stepped hole, the method steps comprising:

providing a metal round blank having a throughhole;

providing a patch block in the throughhole and having a portion of the patch block spaced at a distance from the metal round blank so as to create a stepped area displaced from a plane of the top surface of the metal round blank; and cold-forming the hub by use of at least one pressure roller with the at least one pressure roller fed radially towards the throughhole, wherein material from the metal round blank flows into the stepped area between the metal round blank and a portion of the patch block, thereby forming a stepped hole having a material web at an inner circumference of the hub.

2. The method according to claim 1, wherein the patch block has at least two different diameters at the portion of the patch block.

3. The method according to claim 1, wherein a patch block has a step as the portion of the patch block.

4. The method according to claim 1, wherein the patch block has an external contour with at least one of a partial conical shape and a curved shape.

5. The method according to claim 1, wherein one of the patch block or a pin formed separately from the patch block penetrates the throughhole of the metal round blank.

6. The method according to claim 5, wherein one of the patch block and the pin has a widening diameter in an area of the throughhole, so that a thickness of the web is larger than an initial thickness of the metal round blank.

7. The method according to claim 5, wherein one of the patch block and the pin has a diameter in the area of the throughhole which is smaller than a diameter of the throughhole so that material flows inwardly from an inner diameter of the metal round blank, and wherein a thickness of the web is less than an initial thickness of the metal round blank.

* * * * *